US012426624B2

(12) United States Patent
Gerber et al.

(10) Patent No.: US 12,426,624 B2
(45) Date of Patent: Sep. 30, 2025

(54) METHOD AND APPARATUS FOR STORING AND INHALING VAPOR

(71) Applicant: Glassful Enterprises, Inc., Arlington, MA (US)

(72) Inventors: Michael Seth Gerber, Gloucester, MA (US); Shane Morse Nichols Curcuru, Arlington, MA (US)

(73) Assignee: Glassful Enterprises, Inc., Arlington, MA (US)

( * ) Notice: Subject to any disclaimer, the term of this patent is extended or adjusted under 35 U.S.C. 154(b) by 105 days.

(21) Appl. No.: 17/693,635

(22) Filed: Mar. 14, 2022

(65) Prior Publication Data

US 2022/0232886 A1 Jul. 28, 2022

Related U.S. Application Data

(63) Continuation-in-part of application No. 17/359,766, filed on Jun. 28, 2021.

(60) Provisional application No. 63/205,535, filed on Dec. 22, 2020, provisional application No. 63/205,269, filed on Nov. 30, 2020.

(51) Int. Cl.

| | |
|---|---|
| ***A24F 1/30*** | (2006.01) |
| ***A24F 1/14*** | (2006.01) |
| ***A24F 40/485*** | (2020.01) |

(52) U.S. Cl.

CPC ..... *A24F 1/30* (2013.01); *A24F 1/14* (2013.01); *A24F 40/485* (2020.01)

(58) Field of Classification Search

CPC ..... A24F 1/30

See application file for complete search history.

(56) References Cited

U.S. PATENT DOCUMENTS

| | | | | |
|---|---|---|---|---|
| 4,031,905 | A * | 6/1977 | Dunn | A24F 1/30 131/173 |
| 4,332,246 | A | 6/1982 | Thomson | |
| 9,788,574 | B2 | 10/2017 | Mullen et al. | |
| 2014/0338679 | A1* | 11/2014 | Gransar | A24F 1/30 131/173 |
| 2015/0190604 | A1 | 7/2015 | Lin | |
| 2017/0305731 | A1 | 10/2017 | Kyle | |
| 2017/0354186 | A1* | 12/2017 | Johnson | A61M 11/042 |

(Continued)

FOREIGN PATENT DOCUMENTS

| | | |
|---|---|---|
| WO | 2013192415 | 12/2013 |

OTHER PUBLICATIONS

Brad N, "What Happens When You Replace Bong Water With Other Liquids", Fat Buddha Glass (Feb. 2, 2020), https://fatbuddhaglass.com/blogs/fat-buddha-blog/what-happens-when-you-replace-bong-water-with-other-liquids (Year:2020).

*Primary Examiner* — Michael H. Wilson
*Assistant Examiner* — Courtney G Culbert
(74) *Attorney, Agent, or Firm* — Sand, Sebolt & Wernow Co., LPA

(57) ABSTRACT

Apparatuses and methods for producing, capturing, portioning, and/or distributing smoke or vapor in a manner analogous to liquid consumption that may allow for social and/or more socially acceptable manners of consumption of vapor products. Further, the present disclosure may provide devices and techniques that readily and easily permit transportation, storage, and/or consumption in more socially acceptable and/or less stigmatized manners similar to liquid consumption.

9 Claims, 14 Drawing Sheets

(56) References Cited

U.S. PATENT DOCUMENTS

| | | | | |
|---|---|---|---|---|
| 2019/0230992 | A1* | 8/2019 | Blick | A24F 40/485 |
| 2020/0187560 | A1 | 6/2020 | Trzecieski | |

* cited by examiner

METHOD AND APPARATUS FOR STORING AND INHALING VAPOR

CROSS REFERENCE TO RELATED APPLICATIONS

This application is a continuation-in-part of U.S. patent application Ser. No. 17/359,766, filed on Jun. 28, 2021, which claims the benefit of U.S. Provisional Application Ser. No. 63/205,269, filed on Nov. 3, 2020 and additionally claims benefit of U.S. Provisional Application Ser. No. 63/205,535, filed on Dec. 22, 2020; the disclosures of which are incorporated herein by reference in their entireties.

TECHNICAL FIELD

The present disclosure relates to apparatus and method for consuming aerosols and/or vapors in a manner analogous to the consumption of liquids. More particularly, the present disclosure relates to apparatus and methods for capturing, portioning, and/or distributing smoke or vapor in single-serving and/or portable containers for consumption. Specifically, the present disclosure relates to an apparatus and method for capturing, portioning, and/or distributing smoke or vapor in single use or portable containers for consumption by inhalation in a matter that invokes consuming a liquid.

BACKGROUND

Background Information

Throughout history, people have smoked tobacco and other similar materials such as herbal medicines, *cannabis*, or the like. Evidence for such activities has been found dating back thousands of years; however, until recently, with the advent of electronic vaporization devices, techniques for consuming such organic materials have remained relatively unchanged.

In modern society, consumption of material by smoking is generally given a negative stigma as smoking indoors and around others is highly restricted and consumption of smokable products are highly regulated. Further, as the available consumption techniques are limited, there are inherent physical disadvantages to smoking in addition to these social stigmas conferred by society. For example, consuming a tobacco cigarette in a modern social setting first typically requires the consumer to be outdoors, which, in instances of inclement weather or unfavorable conditions can be a disadvantage in and of itself. Next, the consumer must then ignite the cigarette with a lighter, match, or similar device and then must consume the cigarette by sucking vapor, typically through a filter, before exhaling unwanted byproducts. This technique is difficult and intends to lend negative social and sexual connotations to the act of smoking.

Other smoking devices, such as pipes, hookahs, or the like similarly impart negative stigma while further increasing difficulty and/or disadvantages to the consumer.

Newer devices, such as vape pens or other electronic smoking implements can be expensive, increase waste material, and may introduce additional health and/or safety concerns. For example, many of these newer devices utilize a glycol based medium to deliver the desired product (e.g. nicotine) to the user which can additionally deliver volatile compounds, heavy metals, chemical flavorants and the like in ultrafine particles which can be inhaled deeply into the lungs. This may lead to additional health concerns. Additionally, burns and explosions cause by defective and/or improperly handled battery units present additional risks for the consumer.

When contrasted with other forms of consumption, most notably consumption of liquids including recreational consumption of alcohol, smoking behaviors tend to isolate consumers while more socially acceptable drinking behaviors tend to facilitate group sharing and connection. For example, in a social setting, it is considered much more socially acceptable for a group of individuals to share a round of drinks as compared to a group of individuals sharing a consumable item by smoking. Further, liquid consumption facilitates the ability to divide and distribute a single common portion into individual servings while current smoking technologies do not afford such commonality, distribution, and/or portioning behaviors. Thus, there appear to be significant behavioral benefits regarding posture and comradery that are allowed by liquid consumption technologies that are not as readily available or allowed by current technologies for vapor consumption.

SUMMARY

The present disclosure addresses these and other issues by providing apparatuses and methods for producing, capturing, portioning, and/or distributing smoke or vapor in a manner analogous to liquid consumption that may allow for social and/or more socially acceptable manners of consumption of vapor products. Further, the present disclosure may provide devices and techniques that readily and easily permit transportation, storage, and/or consumption in more socially acceptable and/or less stigmatized manners similar to liquid consumption.

In one aspect, an exemplary embodiment of the present disclosure may provide a method of consuming vapor comprising: extracting volatile oils from an organic material sample in the form of vapor using an extraction device; filling an interior chamber of a container with a volume of liquid; hermetically sealing the container; removing the volume of liquid from the container to draw the vapor from the extraction device and into the interior chamber of the container; and consuming the vapor from the container.

In another aspect, an exemplary embodiment of the present disclosure may provide a method of storing and transporting vapor comprising: extracting volatile oils from an organic material sample in the form of vapor using an extraction device; chilling a container to a temperature below ambient temperature; filling an interior chamber of the chilled container with a volume of liquid; removing the volume of liquid from the container to draw the vapor from the extraction device and into the interior chamber of the container; retaining the vapor within the container without a lid; and consuming the vapor from the container.

In another aspect, and exemplary embodiment of the present disclosure may provide an apparatus for consuming vapor comprising: an extraction device operable to extract vapor from an organic material sample; a fluid vessel having a container defining an interior chamber, the container having a lid with a liquid port and a vapor port defined therein; and a fluid transfer device operable to remove a volume of liquid from the interior chamber of the container to draw the vapor from the extraction device and into the interior chamber of the container for consumption through the vapor port.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

DETAILED DESCRIPTION

Figure 1:
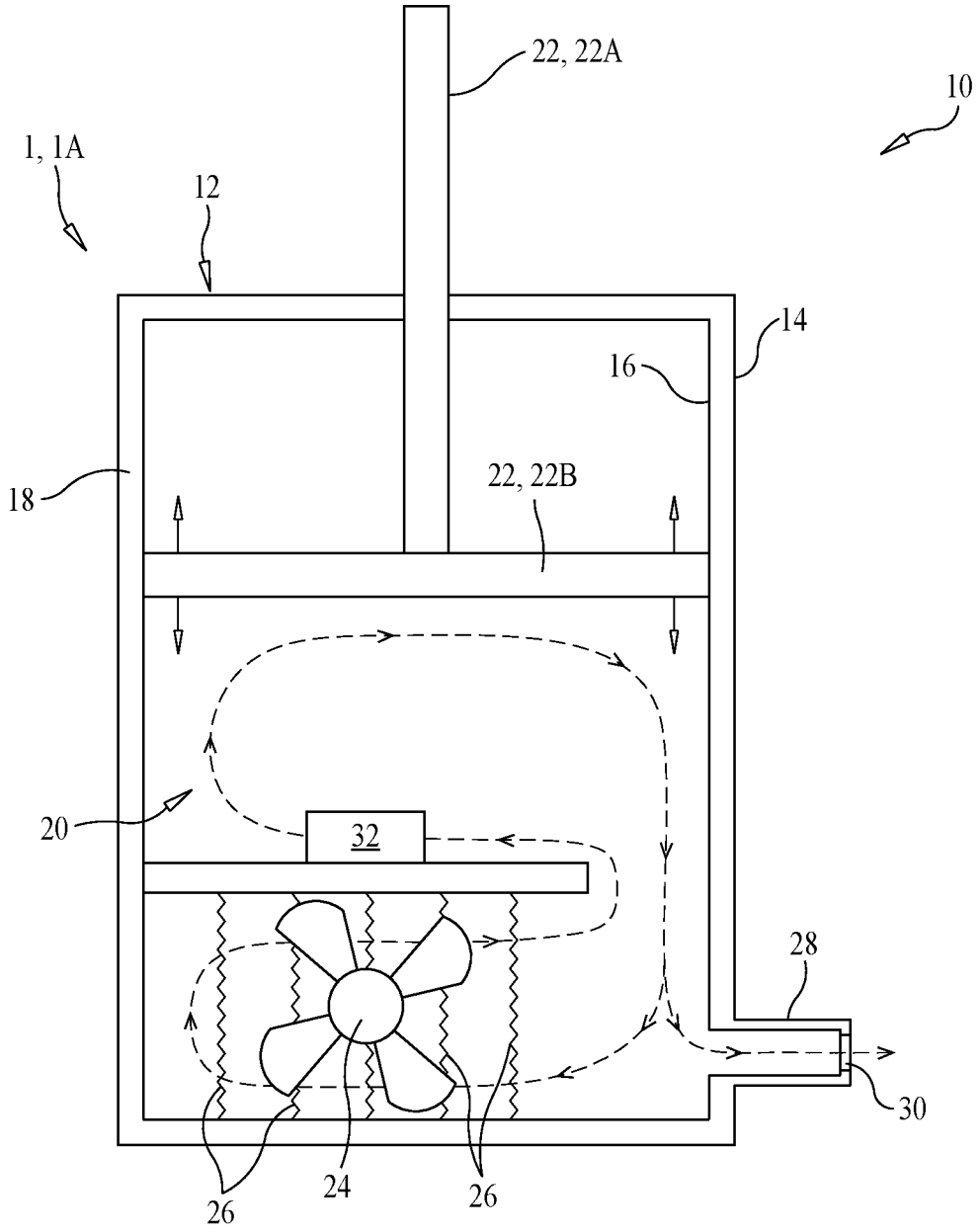
FIG. 1 is a cross-sectional view of an exemplary vapor extraction system, according to one aspect of the present disclosure.

With reference to the figures in general, a vapor extraction and consumption system is shown at 10 and generally referred to herein as vapor system 10 or simply system 10. At its most basic, system 10 may include three main components, namely, a vapor production device 1, a fluid vessel 2, and a fluid storage and transfer device 3. Each of these specific components will be discussed separately and followed by a discussion of the interaction and operation thereof.

With regards to vapor production device 1 and with reference to FIGS. 1 and 2B-2D, various vapor production devices 1 can be seen and will first be described.

Dense vapor is similar to smoke but differs in that it is extracted at temperatures that are typically below the combustion point of cellulose. Current technology for vaporizing essential oils from plant material is limited to hot air convection, which is a process that requires extended time at limited temperatures. At the consumer level, these conditions are typically unattainable as the consumer technology available is limited. As a result, commercially available vapor portions are typically diluted and require multiple servings or an inflated bag.

With reference to FIG. 1, a first vapor production device 1A is shown and will be described. Vapor production device 1A may include an extraction vessel 12 having an outer wall 14 and an inner wall 16 containing an insulation space 18 therebetween. This insulated vessel 12 may further define an interior chamber 20 which may be capped with a plunger 22 having a plunger arm 22A and body 22B. Extraction vessel may further include a fan 24 to circulate the air within the interior chamber 20, a heating element 26 and one or more outlet ports 28. Outlet port 28 may further include a valve 30. While the operation of vapor production device 1A is described further below, as generally seen in FIG. 1, a sample 32 of organic material may be placed inside the interior chamber 20 and sealed therein using plunger 22.

Sample 32 may be a sample of organic material or any other suitable material from which vapor may be extracted. According to one aspect, sample 32 may be a plant-based material, including, but not limited to, tobacco, hemp, *cannabis*, or the like.

Heating element 26 may then heat the air within interior chamber 20 to a temperature of approximately 400 degrees, depending on the type of sample 32 being utilized. Fan 24 may circulate heated air within the interior chamber 20 through the sample 32 to increase the load of desired vapor until the extraction cycle is finished. Vapor then may be transferred out of vapor production device 1A for consumption through outlet port 28 and valve 30, as discussed further below.

Vapor production device 1 may be formed of any suitable material including glass, metal, or the like or, as contemplated, may be formed of any suitable combination of materials configured to allow heated air to be circulated therein. Vapor production device 1A may further include any peripheral components or elements as necessary, including a power source for fan and heating elements, as well as any additional components as necessary for the production of vapor.

As discussed further below, our utilization of vapor production device 1A may allow for large volumes of dense vapor to be produced while maintaining the integrity of the vapor. Put another way, using vapor production device 1A to produce vapor may permit large quantities of vapor to be generated while maintaining the full concentration thereof and may permit production at a consumer or individual user level.

Figure 2A:
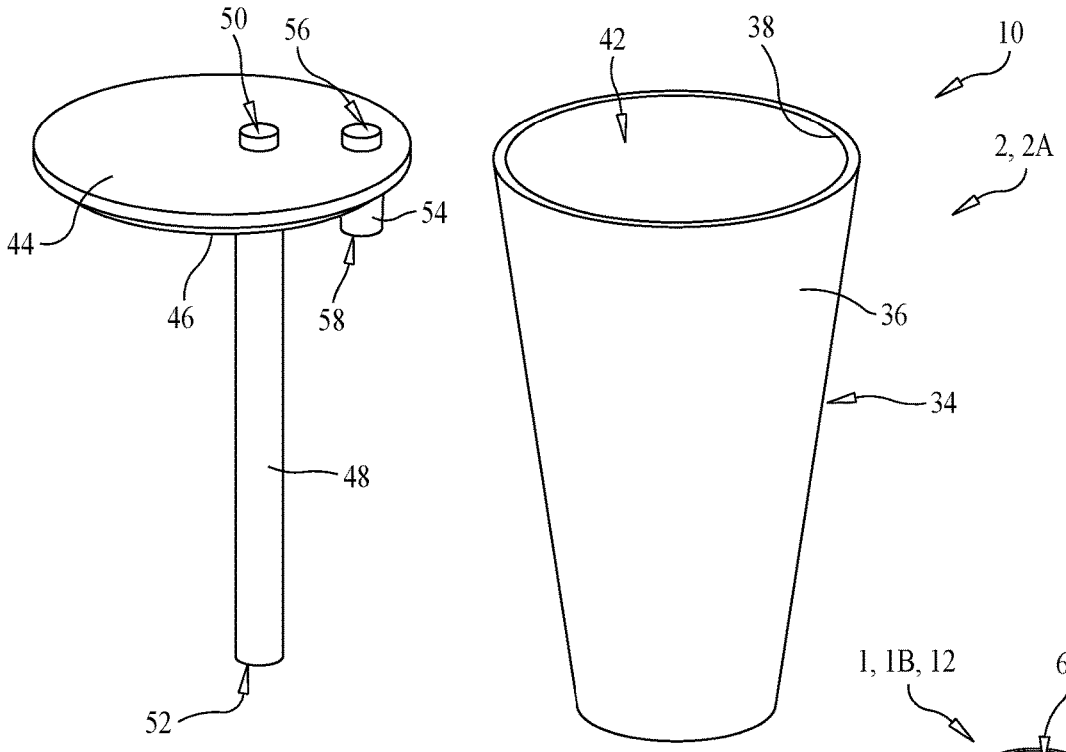
FIG. 2A is a top isometric perspective view of an exemplary consumption vessel and cap, according to one aspect of the present disclosure.
Figure 2B:
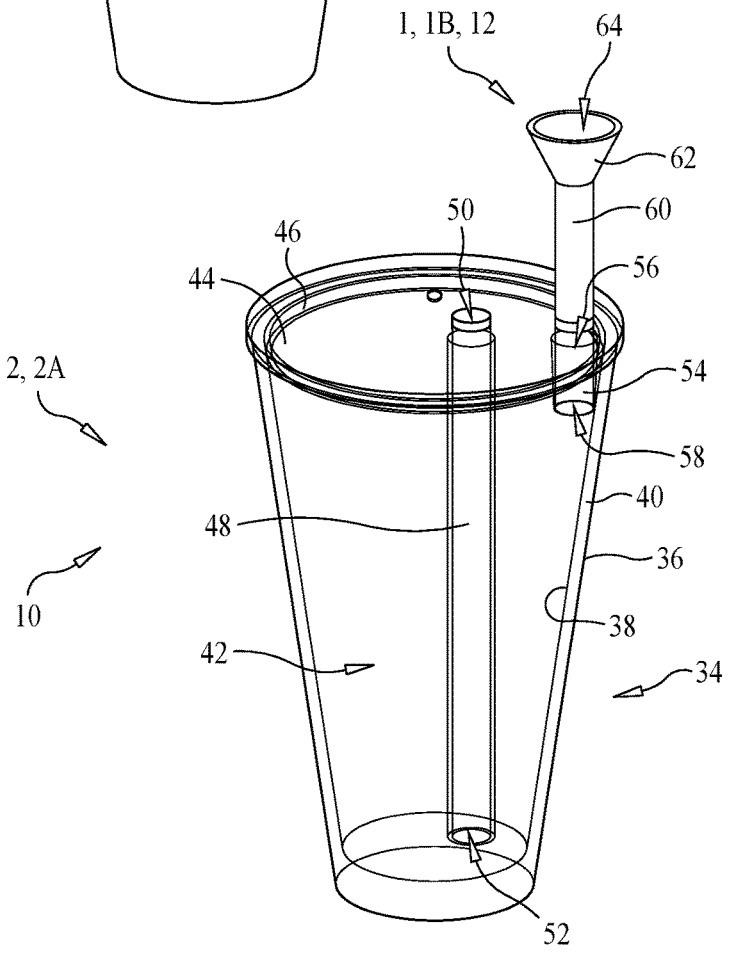
FIG. 2B is a top isometric perspective view of an exemplary consumption vessel and cap with an alternative vapor extraction device operationally connected thereto, according to one aspect of the present disclosure.
Figure 2C:
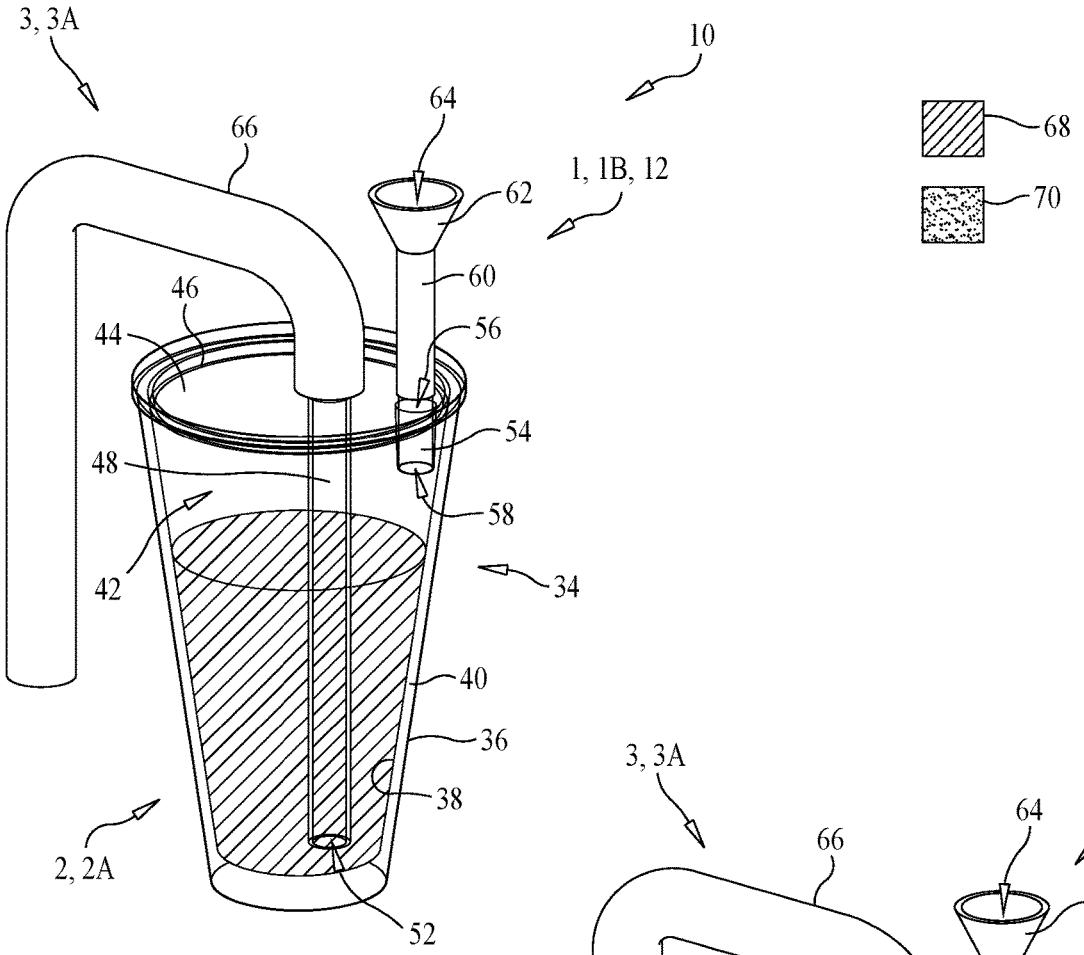
FIG. 2C is a top isometric perspective operational view of the exemplary vessel, cap, extraction device, and fluid transfer device of FIG. 2B, according to one aspect of the present disclosure.
Figure 2D:
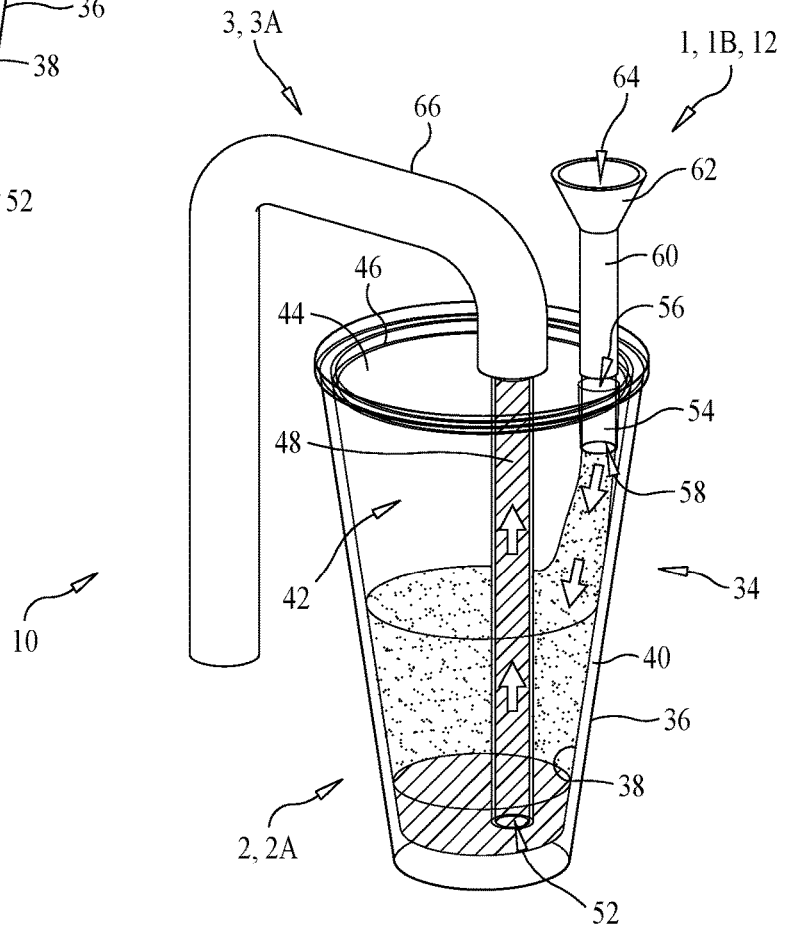
FIG. 2D is a top isometric perspective operational view of the exemplary vessel, cap, extraction device, and fluid transfer device of FIG. 2B, according to one aspect of the present disclosure.

With reference to FIGS. 2B-2D, and as further seen in FIGS. 4 and 6A-6D, a second vapor production device can be seen and is indicated at reference 1B. According to this aspect, vapor production device 1B may be a more simplified extraction vessel 12 having a sample channel 60 with a sample reservoir 62 at a first end thereof. Sample reservoir 62 may have an interior chamber 64, which may receive a sample 32 therein. Interior chamber may be generally open and may be cone-shaped, cylindrical, bowl-shaped, or may have any suitable shape for containing a sample such as sample 32 therein. The operation of vapor production device 1B is described further below but may basically entail applying a heat source 84 (best seen in FIG. 4 at reference 284) to a sample 32 while vapor may be extracted utilizing the sample channel 60 and vapor channel 54 of fluid vessel 2, as discussed further below.

With reference to FIGS. 2A-6D, various fluid vessels 2 are shown and will now be described further. At its most basic, each fluid vessel 2 may be a simple container 34 having an outer wall 36 and an inner wall 38. Some embodiments may include an insulation space 40 therebetween.

As depicted in FIGS. 2A-2D, a first fluid vessel 2A/container 34 may generally resemble a tumbler or pint glass and may further define an interior chamber 42. Vessel 2A may additionally include a lid 44, which may interact with the container 34 to provide a hermetic seal for interior chamber 42, as discussed further below. Accordingly, lid 44 may include a sealing membrane 46, which may be an O-ring, or similar type membrane 46, which may further facilitate the hermetic seal.

Lid 44 may further include a liquid channel 48 having a liquid port 50 at a top end thereof and a check valve 52 at a lower end thereof. Lid 44 may further include a vapor channel 54 having a vapor port 56 at a top end thereof and a vapor aperture 58 at a bottom end thereof. As discussed further below, with regards to the operation of vapor extraction and consumption system 10, the liquid channel 48 and vapor channel 54 may permit liquids and vapors to flow therethrough, respectively.

With reference to FIGS. 3B-6D, a second fluid vessel can be seen and is indicated at reference 2B. According to this aspect, fluid vessel 2B/container 134 may generally resemble or be a wine glass or snifter-type glass, which may be utilized similarly to fluid vessel 2A but for its shape and specific configuration, as, discussed further herein. According to another aspect, vessel 2/container 34 may be drinkware or barware, which may be used for drinking liquids, consuming vapor, or any combination thereof. Where container 134 has a tapered top, such as is shown in the figures, the shape of the vessel 2B may help contain vapor therein while simultaneously being aesthetically pleasing.

Although shown and described with the two examples discussed herein, it will be understood that fluid vessel 2 may generally be any suitable single-serving or multiple servings sized container 34 which may have an interior chamber 42 of sufficient volume to contain liquids and/or dense vapors therein, as discussed below.

According to one aspect, lid 44 may be configured to fit multiple types of fluid vessels 2. Alternatively, a plurality of lid 44 sizes may be readily provided or adapted for different sizes, shapes, and/or configurations of fluid vessels 2, as dictated by the desired implementation.

With reference to FIGS. 2C-6D, various fluid storage and transfer devices are shown and generally indicated at reference 3. Fluid storage and transfer devices 3, at its most basic, may generally be devices utilized for fluid displacement within fluid vessels 2 to draw vapor into fluid vessel 2 for consumption, as discussed further herein. Although a few exemplary embodiments are shown and described below, it will be understood that fluid storage and transfer devices 3 may be any suitable devices and/or may be modified according to the desired implementation and operation thereof. Several examples of use and operation for each device will be described further below with regards to the operation of vapor extraction system 10, in general.

Accordingly, with reference to FIGS. 2C and 2D, a first storage and transfer device is shown and generally indicated at reference 3A. Specifically, fluid storage and transfer device 3A may include a vacuum tube 66, which may cause a displacement liquid, shown and indicated by the diagonal lines at reference 68, to move into and/or out of vessel 2 as discussed further below. Vacuum tube 66 may be operable to draw displacement liquid 68 out of a container 34 which, utilizing the principles of fluid displacement, may draw vapor, indicated at reference 70, into the container 34, as discussed further below. Further according to this aspect, vacuum tube 66 may be attached to the liquid port 50 of liquid channel 48 at one end and may be connected to a vacuum source (not shown), including a fluid reservoir (not shown, or alternatively shown in FIGS. 5A-6D at reference 394 and 494), or other similar storage devices which may be in communication with vacuum tube 66.

Figure 3A:
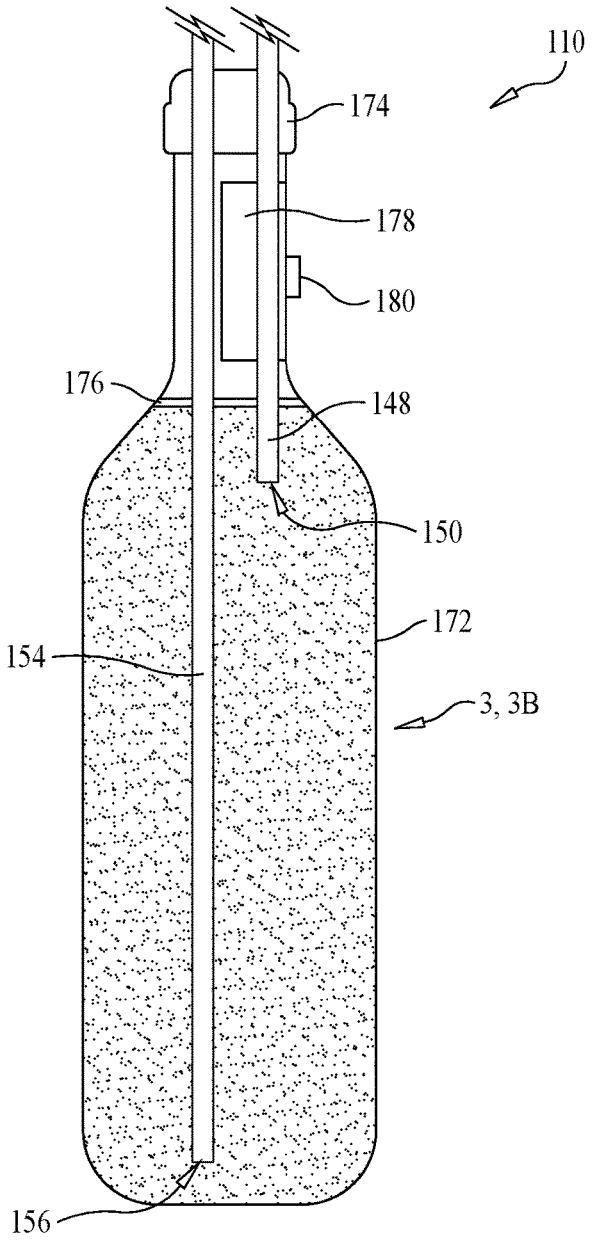
FIG. 3A is a cross-sectional view of an exemplary vapor transfer and/or vapor storage device, according to one aspect of the present disclosure.
Figure 3B:
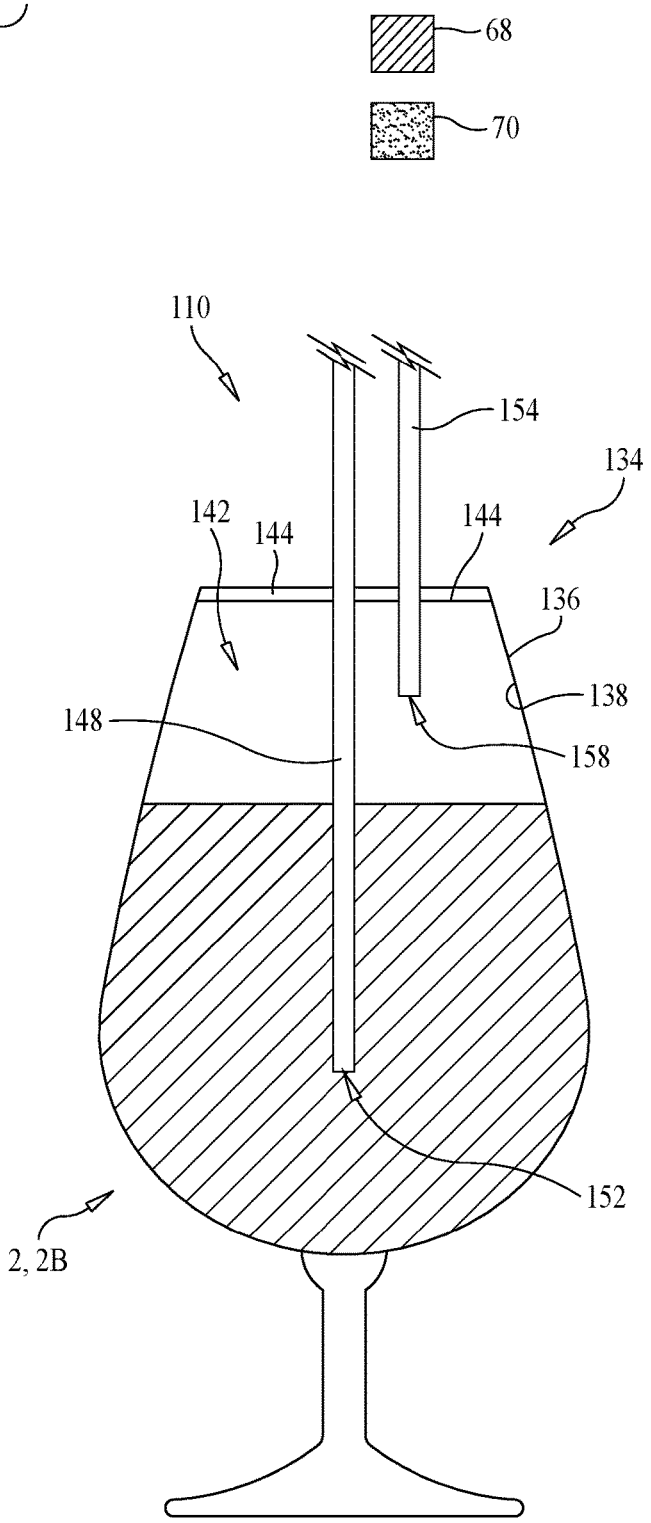
FIG. 3B is a cross-sectional view of an alternative consumption vessel, according to one aspect of the present disclosure.
Figure 3C:
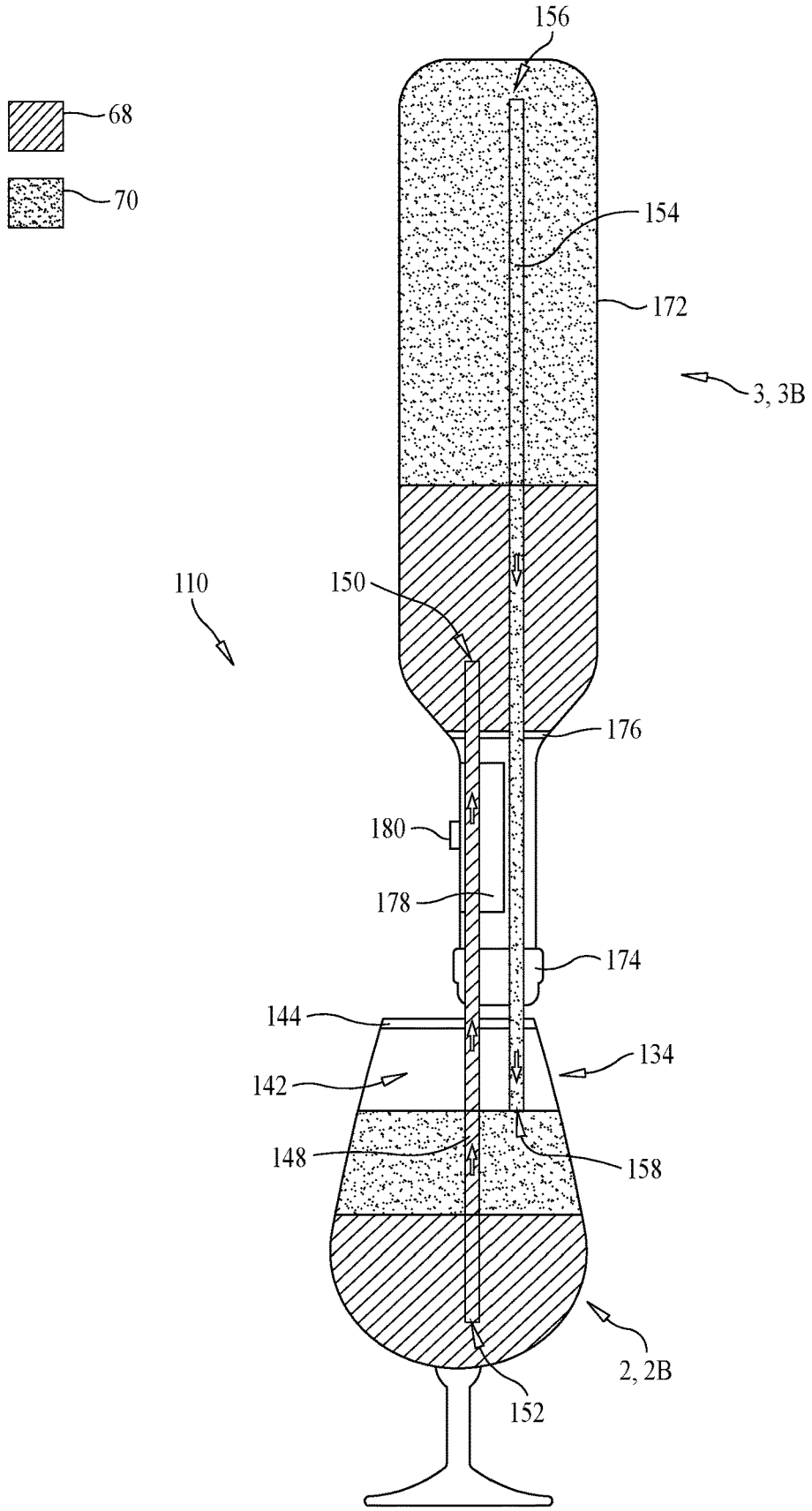
FIG. 3C is a cross-sectional view of the vapor transfer and vapor storage device of FIG. 3A in operational connection to the consumption vessel of FIG. 3B, according to one aspect of the present disclosure.

With reference to FIGS. 3A-3C, a second fluid storage and transfer device is shown and indicated at reference 3B. According to this embodiment, the fluid storage and transfer device 3B may be a bottle or similar vessel, which may allow for storage and transport of a vapor 70 and may further provide a fluid transfer mechanism therewith. Specifically, as seen in FIGS. 3A-3C, storage and transfer device 3B may include a vapor reservoir 172, a sealing member 174, a bulkhead 176, and a liquid pump 178 having an activation switch 180. Each of these components will be more readily understood, as discussed further herein with regards to the operation thereof.

Figure 4:
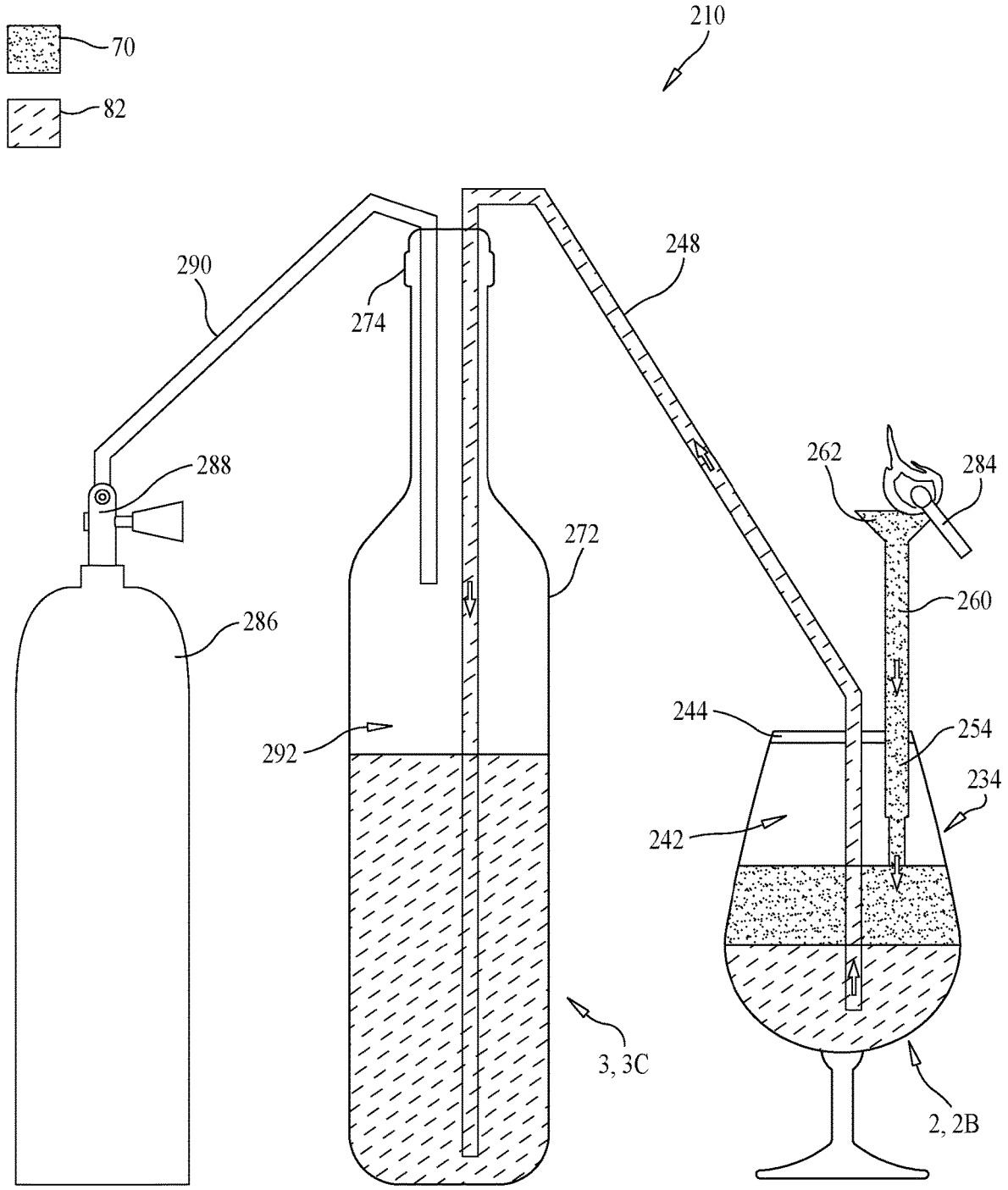
FIG. 4 is a cross-sectional view of an alternate embodiment of a vapor production and transfer system, according to one aspect of the present disclosure.

With reference to FIG. 4, a third fluid storage and transfer device is shown and indicated at reference 3C. The third fluid storage and transfer device 3C may utilize a vapor reservoir 272 which may be substantially similar to vapor reservoir 172 in that it may be a bottle or similar device; however, fluid storage and transfer device 3C may further include a gas canister 286 which may utilize a two-way valve 288 to pass a gas, particularly an inert gas such as $N_2$, or the like, through conduit 290 to enact principles of fluid displacement to fill container 234 with vapor 70. As with other embodiments of fluid storage and transfer device 3, the device as shown in FIG. 4 may best be understood with reference to the operation thereof, and will be described further below.

Figure 5A:
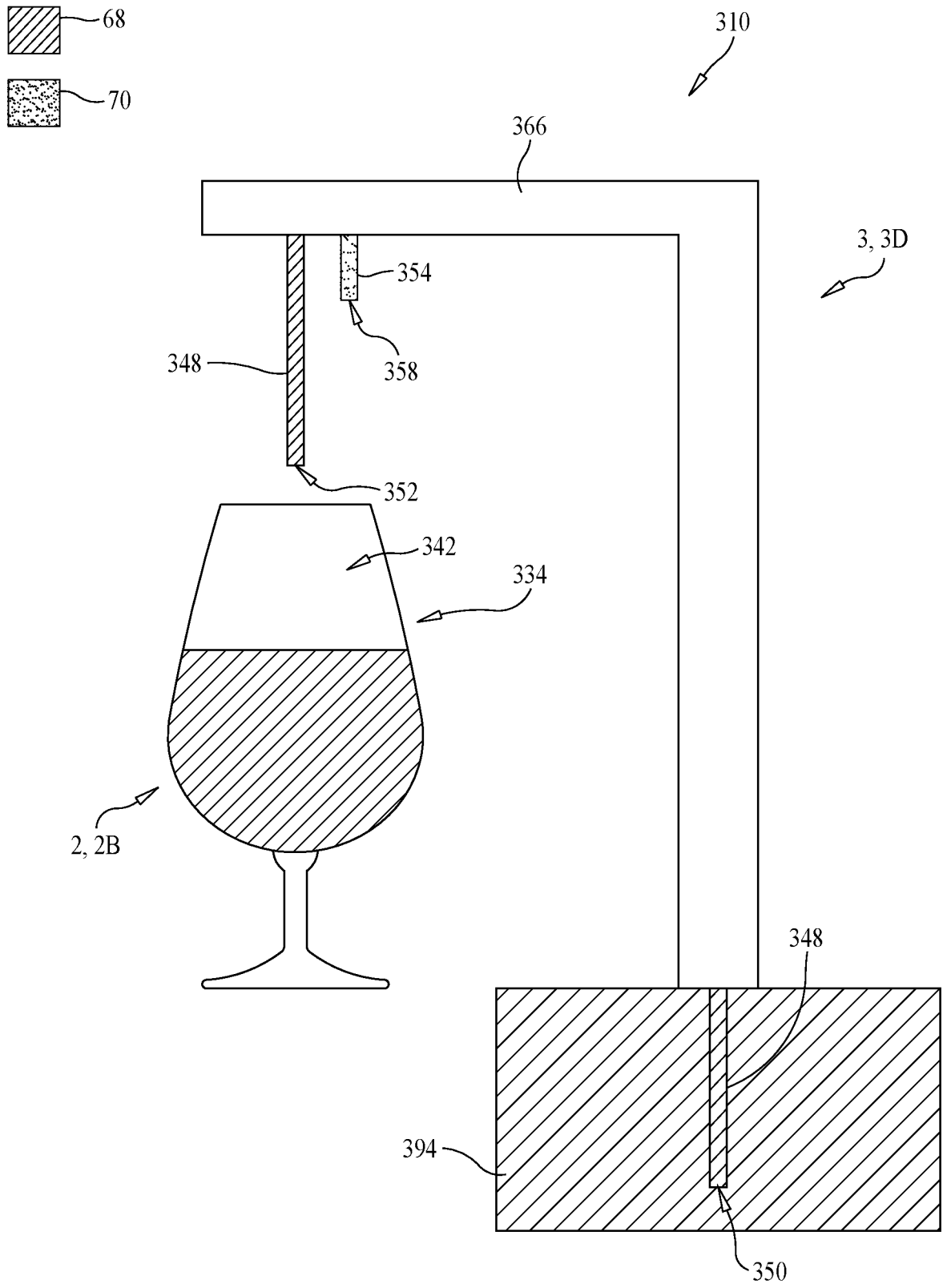
FIG. 5A is a cross-sectional view of an alternate embodiment of a vapor production and transfer system, according to one aspect of the present disclosure.
Figure 5B:
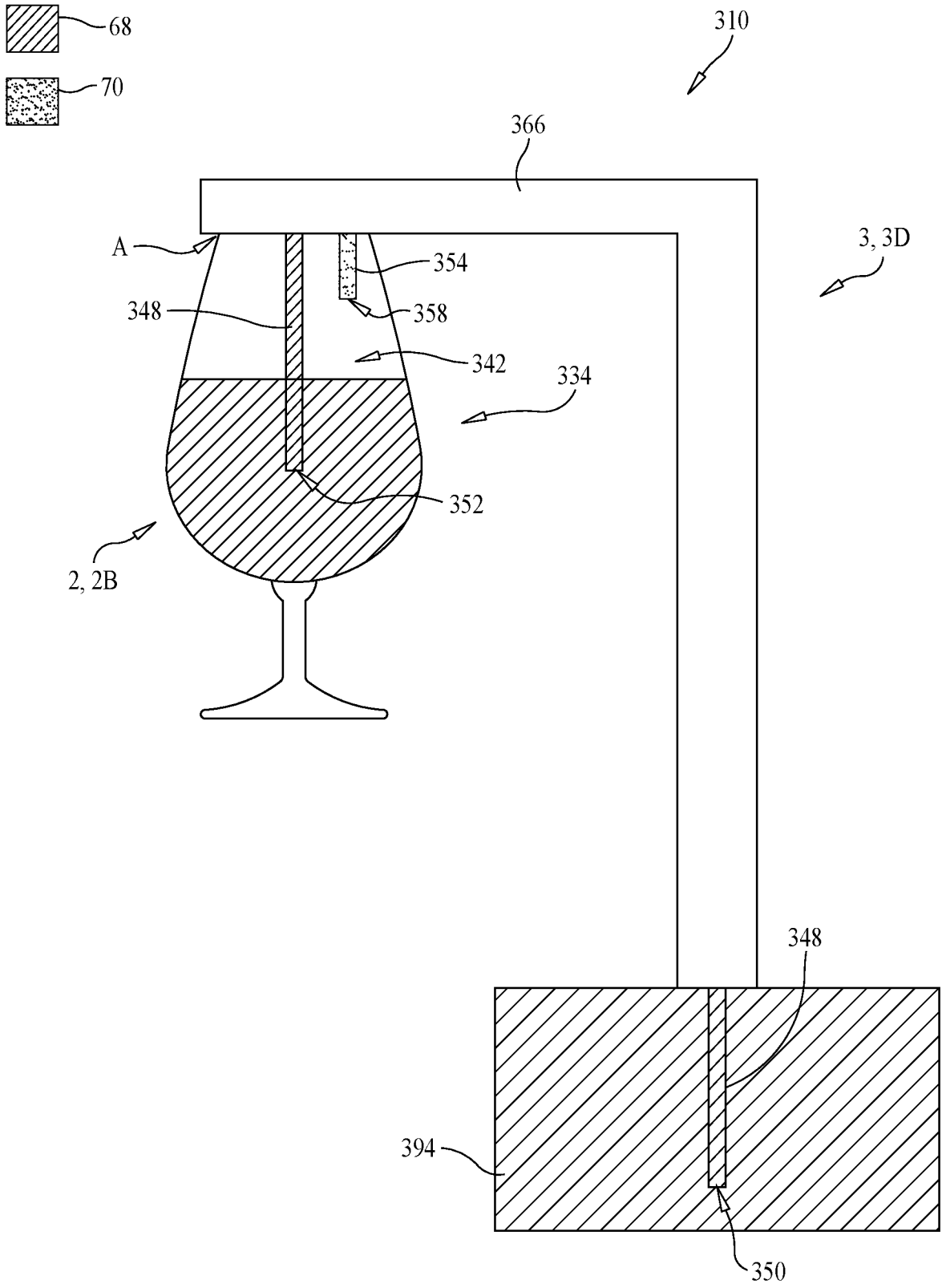
FIG. 5B is a cross-sectional operational view of an alternate embodiment of a vapor production and transfer system, according to one aspect of the present disclosure.

With reference to FIGS. 5A and 5B, a fourth fluid storage and transfer device is shown and generally indicated at reference 3D. This device may include a vacuum tube 366 in communication with a liquid reservoir 394 but may integrate the liquid channel 348 and vapor channel 354 therein and may be operable to both portion dense vapor 70 through fluid displacement principles without the need for lid 44 to be utilized with container 334. Specifically, the need for lid 44 may be eliminated by transferring the vapor 70 at a reduced temperature, which, according to one aspect, may be accomplished using chilled glassware that is cooled below ambient temperature. According to another aspect, the vapor may be stored at a reduced temperature as this will permit the container 334 to retain the vapor within interior chamber 342 for a period of five to ten minutes or more, providing a consumer time to consume the vapor at his/her/their convenience. As with the previous fluid storage and transfer device 3B, the depicted fourth fluid storage and transfer device 3D may best be understood in relation to the operation thereof, as discussed further below.

With reference to FIGS. 6A-6D, a fifth fluid storage and transfer device is shown and generally indicated at reference 3E. The fifth fluid storage and transfer device 3E may further include one or more valve splitters indicated at reference 496. As depicted, two valve splitters 496 may be utilized with a first valve splitter 496A utilized with vapor sample channels 460 with a second valve splitter 496B utilized for liquid transfer. The main difference between the embodiment depicted in FIGS. 6A-6D and other embodiments is that the inclusion of valve splitters 496 may permit the filling of multiple containers 434 simultaneously. Again, as with previous embodiments, the elements and components may best be understood through the discussion of the operation thereof, as discussed further below.

Figure 7:
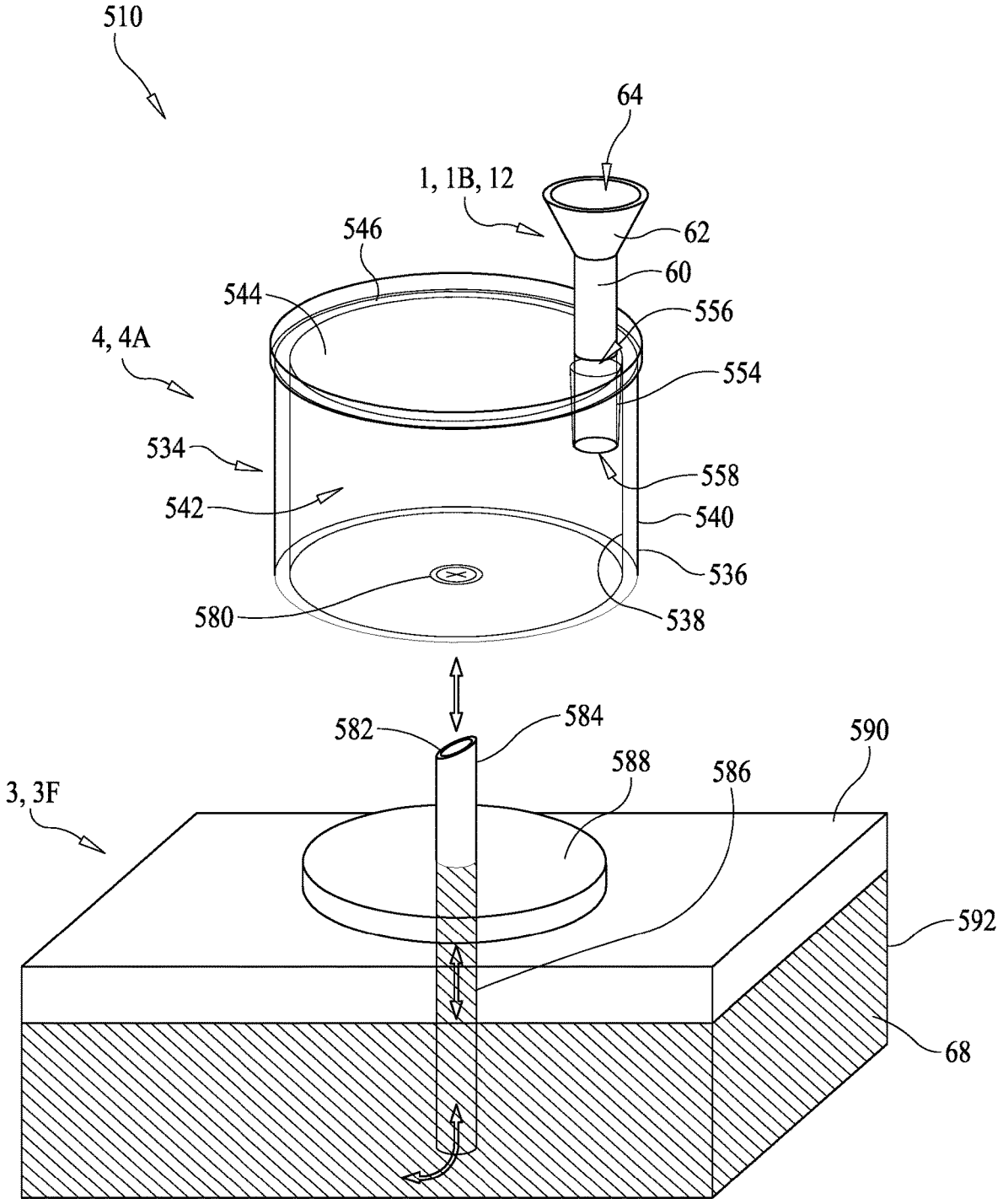
FIG. 7 is a top isometric perspective view of an alternate embodiment of a consumption vessel with an alternative vapor extraction device operationally connected thereto, according to one aspect of the present disclosure.
Figure 8:
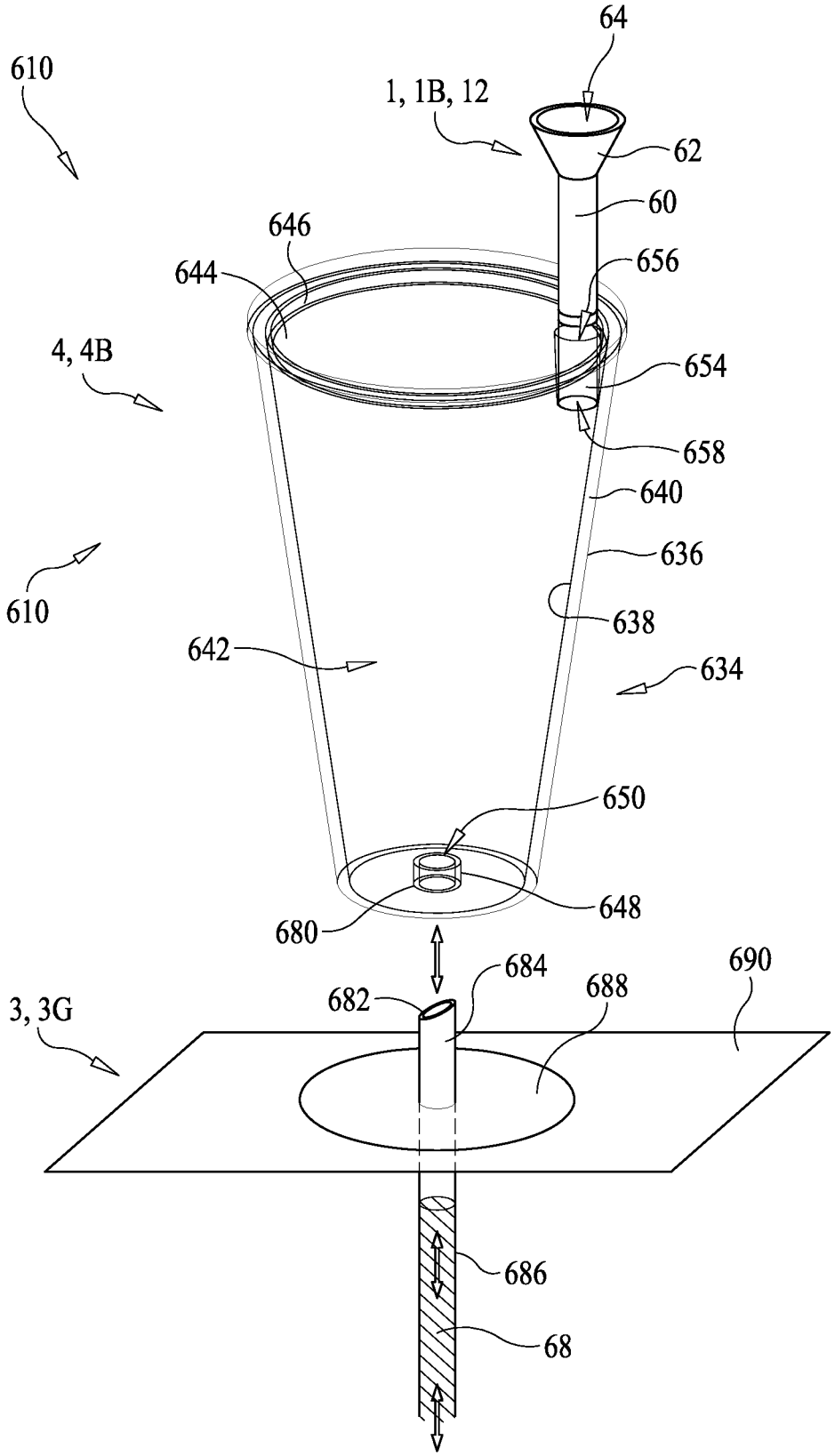
FIG. 8 is a top isometric perspective view of an alternate embodiment of a consumption vessel with an alternative vapor extraction device operationally connected thereto, according to one aspect of the present disclosure.

With reference to FIGS. 7 and 8, alternate embodiments of extraction and consumption systems 510 and 601, and fluid vessels and containers are shown. The vessels and containers are generally referenced as fluid vessels 4, 4A (FIG. 7), and 4B (FIG. 8) and containers 534 (FIG. 7) and 634 (FIG. 8), respectively. These vessels 4 and containers 534, 634, may be substantially similar to their previous discussed counterparts, but for the differences discussed below. Generally, vessels 4/containers 534, 634 may generally be glassware which may include, rocks glasses, tumblers, pint glasses, stem-ware, wine glasses, snifter glasses, or the like, as well as insulated vessels such as cups, mugs, or the like. Vessels 4/containers 534, 634 may be utilized to consume vapors and/or liquids therefrom, as discussed further herein.

With reference to FIG. 7, extraction and consumption system 510 with vessel 4, 4A will now be described. As with vessels 2, 2A, and 2B, vessel 4, 4A may be a modified drinking container, such as a rocks glass (as shown) or the like. Vessel 4, 4A may have a container 534 that may be substantially similar to previous containers (such as containers 34, 134, 234, etc.). In particular, container 534 may have an outer wall 536 and an inner wall 538. Some embodiments may include an insulation space 540. Container 534 may further define an interior chamber 542, and may include a lid 544 therewith.

Lid 544 may be substantially similar to lid 44 except that lid 544 may omit liquid channel 48, liquid port 50 and check valve 52. Similar to lid 44, lid 544 may still include a vapor channel 554 having a vapor port 556 at the top end thereof and a vapor aperture 558 at a bottom end thereof. Vapor channel 554 may be substantially similar or identical to vapor channel 54 and may allow interaction with a vapor extraction device, such as extraction device 1, 1B, as shown.

Although shown as a "rocks" style glass, it will be understood that fluid vessel 4, 4A may generally be any suitable single-serving or multiple servings sized container 534 which may have an interior chamber 542 of sufficient volume to contain liquids and/or dense vapors therein, as discussed further below.

Container 534 may differ from previous embodiments described above in that container 534 may have a valve or port 580 defined in the bottom of the container 534. Port 580 may be any suitable self-sealing or self-closing style of aperture. According to one example, as shown in FIG. 7, port 580 may be a self-sealing membrane and may be formed of any suitable food grade and/or food safe material, such as silicone or the like. As shown in FIG. 7, port 580 may be substantially planar with the bottom of the container 534; however, it will be understood that other forms or modifications can be made to the shape, size, and/or placement of port 580, as dictated by the desired implementation. According to one example, as shown in FIG. 8 and discussed further below, port 680 may have a channel 648 including an aperture 650 that may define the port 680. This may include a one-way valve, a check valve, or any other suitable self-sealing device thereon. According to another example, ports 580 or 680 may be mechanically sealed through self-sealing magnetic engagement or through other similar mechanical connections. According to yet another aspect, ports 580 or 680 may be any suitable or operational combination of valves, membranes, or the like. For example, the fill tube 584, 684 may include a magnet operable to draw a second magnet with the container 534, 634 downwards to cause a self-sealing membrane to open, allowing the passage of fluid therethrough. Moving the container 534, 634 away from the tube magnet will break this bond and the membrane can rebound to again seal the container 534, 634 to prevent leakage.

In general, port 580 may allow the container 534 to be filled with liquid (such as displacement liquid 68) from the bottom using a fluid storage and transfer device 3, 3F, as discussed below. Similarly, port 580 may allow any liquid or other fluids within container 534 to be extracted from the bottom of container 534. Where container 534 is a glass or other similar container having a flat or substantially flat bottom, port 580 may be integrally formed within the bottom thereof. Where the bottom of container 534 is not flat, or is otherwise extended (e.g. the stem of a wine glass or the like), port 580 may be likewise extended and/or modified for such uses through the use of additional channels or tubes, as desired. Port 580 will be better understood through discussion of the operation and use thereof, which is provided in more detail below.

Container 534, or more particularly port 580, may interact with a tip 582 of a tube 584. This tip 582 may be configured to be inserted within port 580 to provide a connection between the interior chamber 542 of container 534 and a liquid channel 586 defined through the interior of tube 584. This may further allow for interaction between the fluid storage and transfer device 3F for functional connection and operation therebetween, as discussed below.

Fluid storage and transfer device 3F may be substantially similar to prior embodiments (particularly fluid storage and transfer devices 3D and 3E) in that it may have a reservoir 592 filled with or otherwise containing a displacement liquid 68 therein. Fluid storage and transfer device 3F may differ from prior embodiments in that it may operate from below the container 534, as discussed below, and may include a base plate or fill plate 588 carried on a top surface 590 of the reservoir 592. This top surface 590 may be operable to support the fill plate 588 and container 534 thereon when port 580 of the container 534 is engaged with tube 584.

Fluid storage and transfer device 3E will be understood to include any suitable or necessary components and elements for the proper operation thereof. For example, fluid storage and transfer device 3E may have one or more pumps or the like to move fluid into and out of the interior chamber 542 of container 534 as described below. Similarly, it will be understood that fluid storage and transfer device 3E may be scaled or modified to simultaneously support more than one vessel 4 and/or vessel type for operational use thereof.

Fill plate 588 may define the proper position of container 534 for operational engagement of tube 584 with port 580 and may have any suitable shape or position, as desired. According to one aspect, fill plate 588 may be substantially circular and may be raised above top surface 590 of fluid storage and transfer device 3E. While aesthetically pleasing, this raised configuration may further provide a shelf or support surface to further support the container 534 during the filling operation.

According to another aspect, fill plate 588 may include sensors, switches, or the like to determine the presence of a container 534 thereon for automatic filling. For example, fill plate 588 may include a scanner, which may interact with a barcode, QR code, or the like provided on the bottom of the container 534, which may provide information about the container such as volume, type, or the like. This information about the container 534 may allow the system 510 to automatically disperse an exact volume of displacement liquid 68 into the container 534. According to yet another aspect, fill plate 588 may be an integrated switch, which may be depressed by the action of placing the container 534 thereon, this initiating the filling process. Removing the container 534 therefrom may then allow the integrated switch to reverse and stop the filling process.

With reference to FIG. 8, extraction and consumption system 610 with another embodiment of vessel 4, 4B is shown having another container 634. Both vessel 4B and container 634 may be substantially similar to vessel 4A and container 534 but for the shape and or size thereof. For example, where vessel 4A is shown as a "rocks" style glass, vessel 4B may be a pint glass or tumbler styled container 634. Additionally, as shown, containers 534 and 634 may differ in the form/operation of ports 580 and 680, as described herein; however, it will be understood that any suitable port 580/680 (or other configurations thereof) may be utilized with any suitable containers 534, 634, or the like.

Similarly, FIG. 8 depicts a modified fluid storage and transfer device 3, 3G which may include a reservoir (not shown) having a top 690 and fill plate 688 thereon. Fluid storage and transfer device 3G may further include tube 684, which may be substantially similar to tube 584 and may be operated substantially identically, as described below.

In this configuration, fill plate 688 is shown substantially flush or planar with top surface 590 of fluid storage and transfer device 3G; however, as discussed above with reference to fill plate 588, fill plate 688 may have any suitable configuration or position, as desired.

Having thus described the general elements and components of vapor extraction system 10, the operation and use of the various embodiments thereof will now be described in more detail. The methods of operation and use described herein may be made with reference to certain embodiments; however, it will be understood that these methods may be utilized with all embodiments equally unless specifically stated otherwise.

With reference to FIG. 1, vapor production utilizing vapor production device 1A may be performed according to the following method. As mentioned above, a sample 32 may be placed within the interior chamber 20 of extraction vessel 12 and plunger 22 may be raised or lowered, as indicated by the arrows in FIG. 1, to increase or decrease the desired volume of air within interior chamber 20. Then heating element 26 may be powered on, which may heat the air within interior chamber 20 to a desired temperature, typically around 400 degrees Fahrenheit, while the air is circulated throughout the interior chamber 20 and through sample 32.

As the heated air passes through sample 32, volatile oils are extracted therefrom and suspended in the air as vapor which may continue to circulate throughout interior chamber 20 as long as fan 24 is powered on. Once a sufficient volume and/or concentration of vapor is produced from sample 32, valve 30 on outlet port 28 may opened and a volume of vapor may be removed from interior chamber 20, as desired. Vapor may be removed from extraction vessel 12 through outlet port 28 and valve 30 through any suitable means including vacuum, liquid displacement, or the like, as described further below. According to one aspect, a sufficient volume of vapor may be determined as a volume that is at least sufficient to replace an entire volume of liquid within a container 34. This volume may vary depending upon the desired implementation and/or amount of vapor desired to be consumed in a serving. Similarly, a sufficient concentration of volatile oils within the vapor may be any desired concentration and may vary depending upon specific tastes of the consumer, the specific type of organic material used as sample 32, or other similar factors. According to one example, a sufficient concentration may be a concentration wherein a desired flavor is imparted into the vapor from the oils. According to another example, a sufficient concentration may be a saturation concentration wherein no additional volatile oils may be suspended within the vapor.

Plunger 22 may be raised or lowered according as indicated by the arrows in FIG. 1 to expand the volume of interior chamber 20, which may lower the air pressure within the interior chamber which may, in turn, lower the vapor point of the essential oils within sample 32 making it easier and more efficient to extract those essential oils.

With reference to FIGS. 2B-2D, 4, and 6A-6D, vapor production utilizing second vapor production device 1B may be accomplished by placing a sample, such as a sample 32, within the interior chamber 64 of vapor production device 1B. Then, a heat source 84 (depicted in FIG. 4 as heat source 284 and in FIG. 6B as heat source 484) may be applied to the sample to cause the essential oils therein to be extracted therefrom as vapor. Simultaneously, utilizing fluid displacement methods as discussed below, this vapor may be pulled through sample channel 60 and out of the vapor production device 1B.

Utilizing vapor production device 1A may allow for continuous production and extraction of vapor as desired and may be useful in scenarios where refills and multiple servings of vapor may be produced, while vapor extraction device 1B is contemplated for producing smaller and/or single servings of vapor for consumption as desired. It will be understood, however, that vapor devices 1A and 1B may be interchangeable depending upon the desired implementation and use thereof. Alternatively, other vapor production devices not described or discussed herein may be utilized with the fluid transfer methods described below, provided they can generate sufficient volumes of vapor from a sample while maintaining a desired concentration thereof.

With reference to FIGS. 2A-2D, a first method of vapor transfer utilizing fluid vessel 2A and fluid storage and transfer device 3A will now be described. Specifically, vapor may be produced utilizing either vapor production device 1A or 1B while the container 34 may be filled or partially filled with a liquid such as displacement liquid 68. While displacement liquid 68 is contemplated to be consumable, according to this embodiment, displacement liquid 68 is not to be consumed with the vapor (as contrasted with consumable liquid 82, discussed further herein). According to one aspect, displacement liquid 68 may be water.

The volume of interior chamber 42 of container 34 that is prefilled with displacement liquid 68 may define a similar volume of vapor 70 that will occupy space within interior chamber 42 of container 34. As best seen in FIGS. 2C and 2D, fluid storage and transfer device 3A may be connected to lid 44 as to provide a seal around liquid channel 48 and liquid port 50. Then fluid storage and transfer device 3A may be activated such that vacuum tube 66 may draw the displacement liquid 68 up through liquid channel 48 and out of container 34. The force of the liquid being drawn out of interior chamber 42 of container 34 may force check valve 52 of liquid channel 48 open, allowing displacement liquid 68 to flow freely from container 34.

Since the container 34 is hermetically sealed by lid 44 and membrane 46, the drawing of displacement liquid 68 out of the interior chamber 42 would create a vacuum effect that would draw vapor 70 out of a vapor production device 1 and into interior chamber 42 of container 34, as seen best in FIG. 2D. Once all displacement liquid 68 is removed from container and replaced by vapor 70, the fluid storage and transfer device 3A may be disconnected, as may be vapor production device 1, and the vapor port 56 may then be utilized to sip or consume the vapor contained within interior chamber 42 of container 34. Specifically, the vapor 70 may then be drawn out of interior chamber 42 through vapor aperture 58 and vapor port 56 through the act of "sipping" by the end consumer.

With reference to FIGS. 3A-3C, a second embodiment of vapor system 110 utilizing second fluid vessel 2B and second fluid storage and transfer device 3B is shown and will now be described. Specifically, this embodiment assumes vapor 70 is produced and transferred into a storage container 3B, as best seen in FIG. 3A, and may be transported to any desired location. According to this embodiment, liquid channel 148 and vapor channel 154 may extend both into fluid vessel 2B and fluid storage and transfer device 3B to allow displacement flow of displacement liquid 68 and vapor 70 therebetween. To further facilitate such fluid displacement, fluid storage and transfer device 3B may include a liquid pump 178, which may be operable to draw displacement liquid 68 out of fluid vessel 2 causing vapor 70 to transfer therein. Specifically, fluid vessel 2B may be provided with a volume of displacement liquid contained therein while fluid storage and transfer device 3B may be inverted such that liquid channel 148 and vapor channel 154 connect and create a continuous channel between fluid vessel 2B and fluid storage and transfer device 3B. Then utilizing activation switch 180, liquid pump 178 may be activated to, again, draw displacement liquid out of fluid vessel 2B and into fluid storage and transfer device 3B while simultaneously causing vapor 70 to be transferred into interior chamber 142 of container 134. Again, when the desired volume of vapor 70 replaces the displacement liquid 68, the fluid storage and transfer device 3B may be removed from the fluid vessel 2B and vapor 70 may be consumed therefrom.

With reference to FIG. 4, a third embodiment of vapor system 210 and a method of transferring vapor for consumption is shown and will be described. Specifically, as seen in FIG. 4, vapor system 210 may utilize a modified third fluid storage and/or transfer device indicated at 3C with a fluid vessel such as fluid vessel 2B; however, according to this aspect, the displacement liquid 68 may be replaced with a consumable liquid 82. Again, as discussed above, displacement liquid 68 may be consumable in that it is safe for consumption; however, it is not intended to be consumed. Consumable liquid 82 may be intended to be consumed with vapor 70. According to one example, consumable liquid 82 may be a spirit or wine, which may be complementary to the type of vapor being consumed to enhance the consumption experience with additional flavors, textures, mouthfeel or the like. Accordingly, fluid storage and transfer device 3 may be utilized with consumable liquid 82 and a volume of consumable liquid 82 may be placed within container 234 and then drawn out therefrom to draw vapor 70 in through vapor channel 254 and into interior chamber 242 of container 234.

An additional feature illustrated in FIG. 4 is the use of a separate device to cause fluid transfer between fluid vessel 2B and fluid storage and transfer device 3C in the form of a separate gas canister 286 having a valve 288 attached thereto. Specifically, gas canister 286 may direct an inert gas, such as nitrogen or the like, through a conduit 290 and into and/or out of fluid storage and transfer device 3C to effect fluid displacement principles to transfer consumable liquid 82 between fluid storage and transfer device 3C and container 234. This may allow fluid storage and transfer device 3C to remain upright, minimizing the chance that consumable liquid 82 is spilled or otherwise wasted.

With reference to FIGS. 5A and 5B, a fourth embodiment of vapor system 310 and fluid storage and transfer device 3D is shown and will be described. As contemplated, this may be a commercial or more permanent style vapor system 310, which may allow quick and easily repeatable portions of vapor to be produced and provided. Specifically, a fluid vessel, such as fluid vessel 2B, may be partially filled with a volume of displacement liquid 68 (or consumable liquid 82, as desired) and may be raised to create a seal between the top of container 334 and the vacuum tube 366 of fluid storage and transfer device 3D, as best seen in FIG. 5B. At this point, vacuum tube 366 may draw displacement liquid 68 from container 34 and into a reservoir 394 through liquid channel 348 while simultaneously transferring vapor 70 from a separate vapor channel 354 and vapor aperture 358 and into interior 342 of container 334. This system may similarly utilize fluid displacement techniques but may be in communication with a vapor storage (not shown) or may be similarly connected to a vapor production device such as vapor production device 1A operable to continuously or semi-continuously produce vapor from samples 32. This system is contemplated for use in establishments where multiple servings of vapor may be provided over an extended period of time. However, the principles of fluid transfer remain similar as with other embodiments wherein the removal of displacement liquid 68 from interior chamber 342 may cause vapor 70 to be pulled therein for consumption.

Figure 6A:
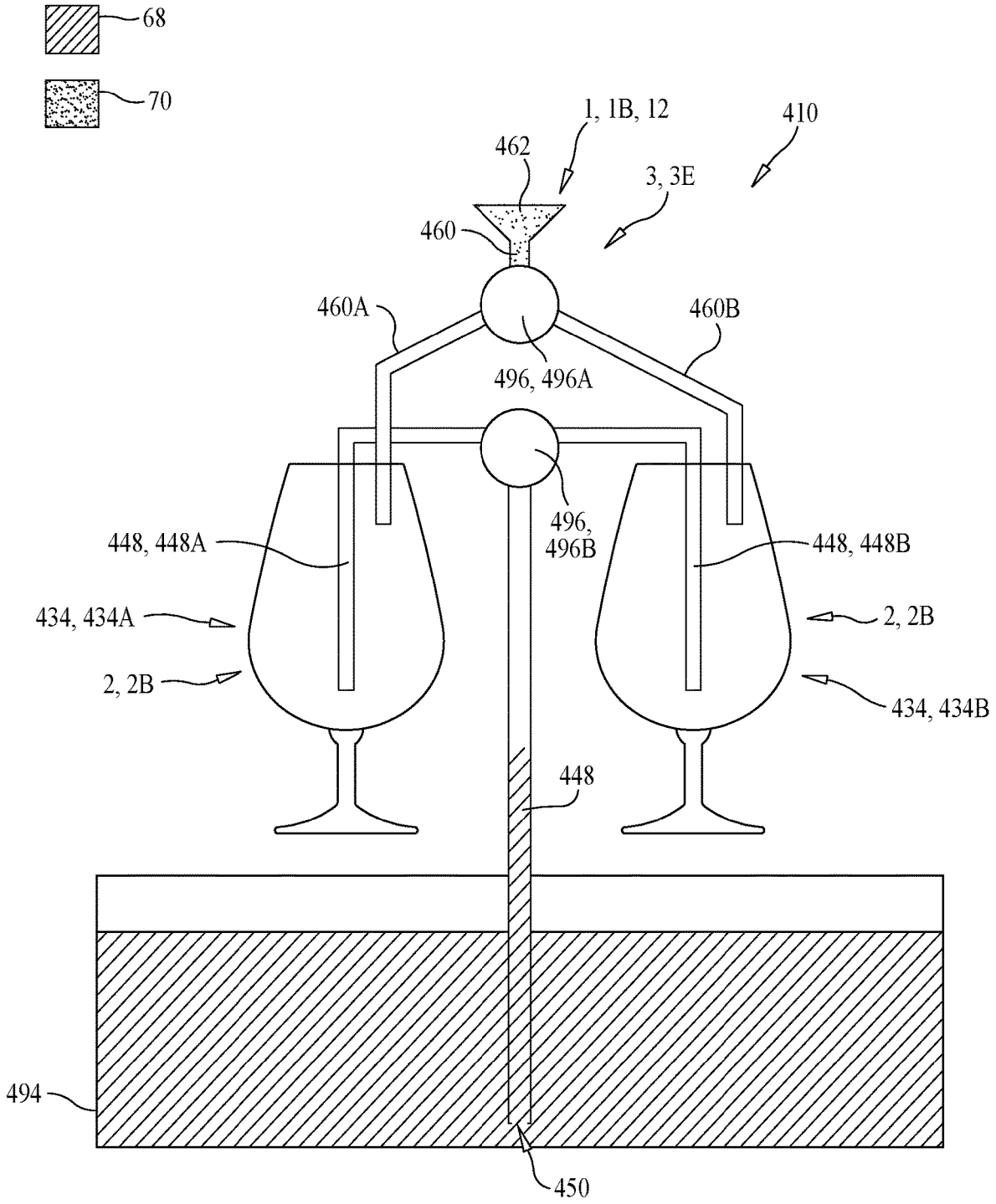
FIG. 6A is a cross-section operational view of an alternate embodiment of a vapor extraction system for use with multiple vessels, according to one aspect of the present disclosure.
Figure 6B:
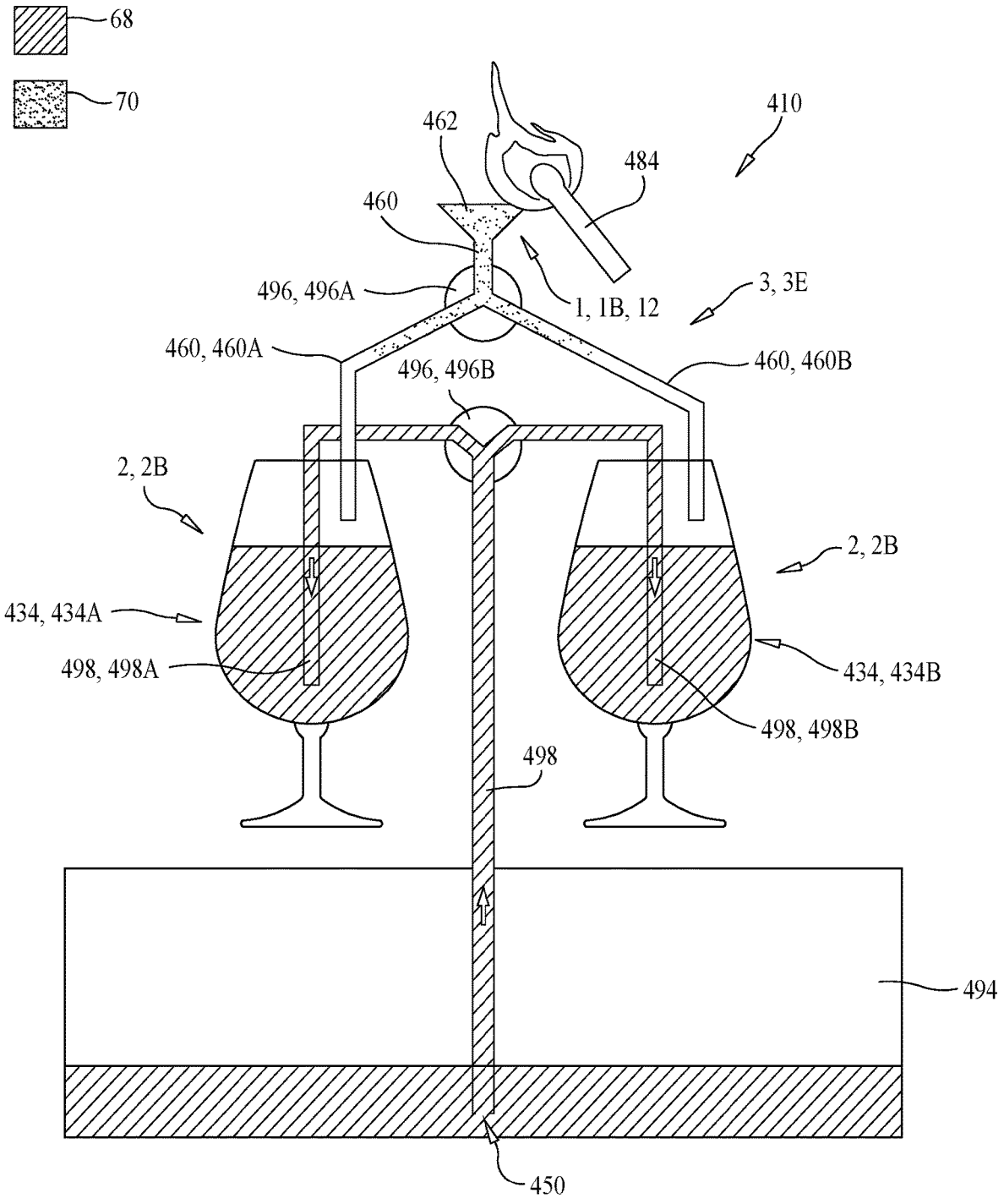
FIG. 6B is a cross-section operational view of an alternate embodiment of a vapor extraction system for use with multiple vessels, according to one aspect of the present disclosure.
Figure 6C:
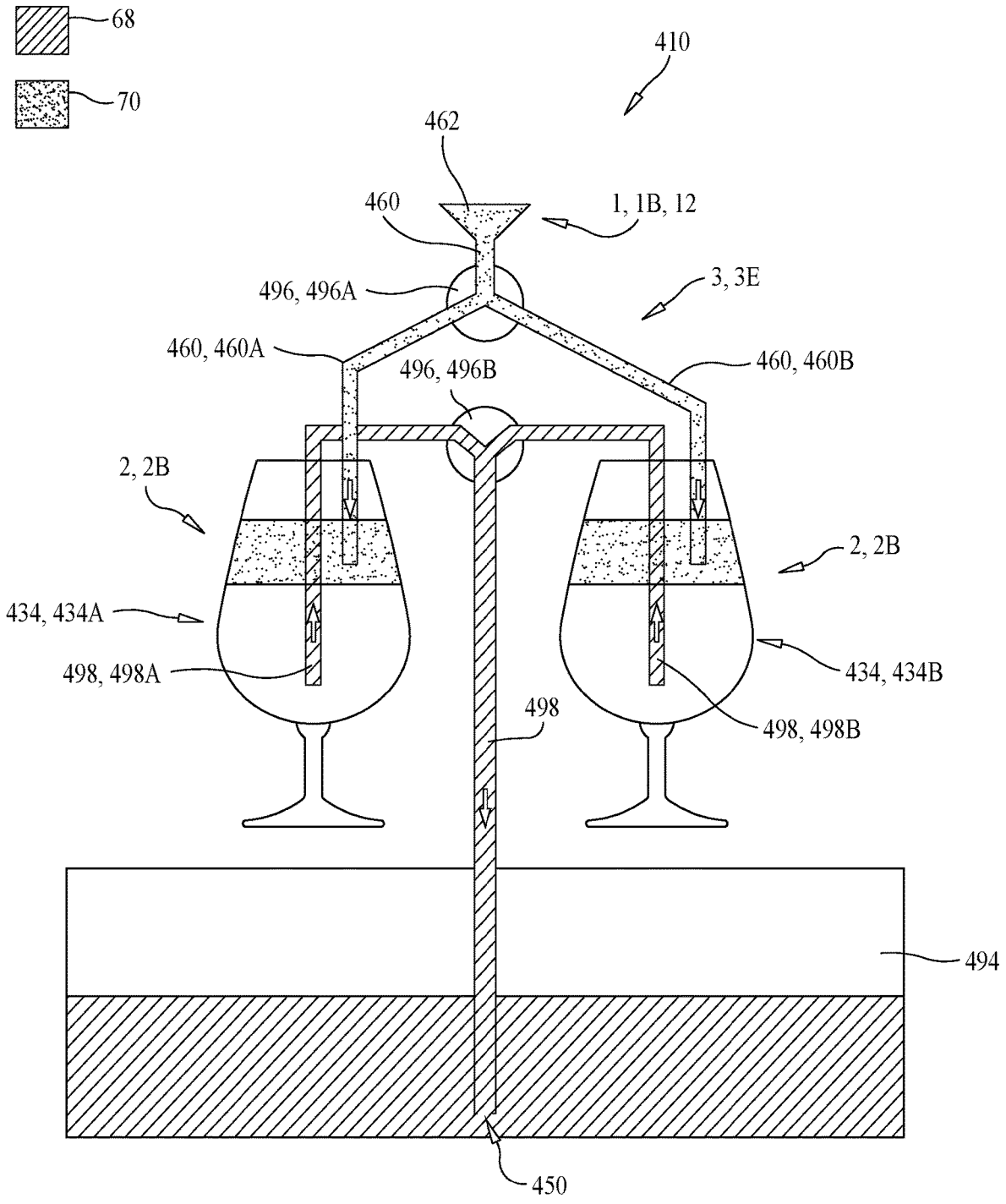
FIG. 6C is a cross-section operational view of an alternate embodiment of a vapor extraction system for use with multiple vessels, according to one aspect of the present disclosure.
Figure 6D:
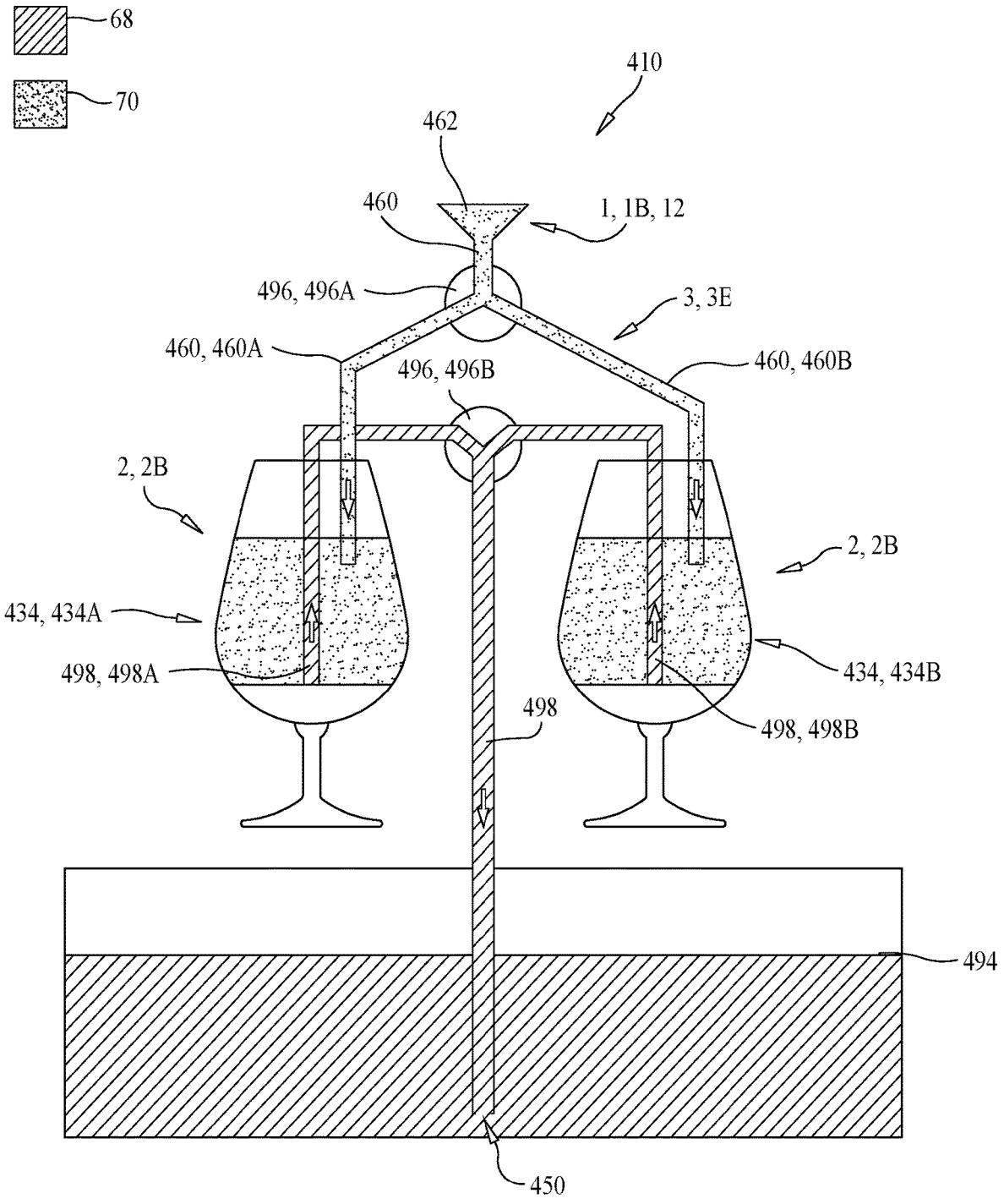
FIG. 6D is a cross-section operational view of an alternate embodiment of a vapor extraction system for use with multiple vessels, according to one aspect of the present disclosure.

With reference to FIGS. 6A-6C, a fifth embodiment of extraction and consumption system 410 is shown and will now be described. A fifth embodiment of fluid storage and transfer device is indicated at reference 3E, which may be substantially similar to the device of 3D; however, it may further include valve splitter 496 which may allow multiple containers 434, such as a first container 434A and a second container 434B, to be filled simultaneously. These valve splitters 496A and B may optionally include a pump therein to further facilitate the movement of fluids between first and second channels, such as first liquid channel 448A and second liquid channel 448B and/or vapor channels 460A and 460B. As shown, such a device may be utilized with a vapor production device 1B or the like; however, it will be understood that vapor production device 1A may be readily connected and operated therewith.

With reference to FIGS. 7 and 8, the operation of extraction and consumption systems 510 and 610, along with fluid storage and transfer devices 3F and 3G will now be described. Collectively, the two fluid storage and transfer devices 3F and 3G will be referred to as the "bottom fill" devices and references thereto are equally applicable unless specifically stated otherwise. Accordingly, the operation of bottom fill devices 3F and 3G will be described with reference to vessel 4A and container 534; however, it will be understood that these references are general to the operation and that any of the vessels 4 can be utilized with the bottom fill devices 3F and 3G.

The bottom fill devices 3F and 3G may operate in a very similar manner to the previously discussed fluid storage and transfer devices but for their filling and extraction of the displacement liquid 68 through the bottom of containers 534 and/or 634. Accordingly, container 534 may be moved over the bottom fill devices 3F, 3G and aligned such that port 580 is directly above the tip 582 or tube 584. Container may be lowered onto tip 582, which may mechanically cause the port 580 to open. For example, where port 580 is a self-sealing membrane, tip 582 may "pierce" the membrane and be inserted into the interior chamber 542 of container 534. Where port 580 is a different type of self-sealing device, tip 582 may mechanically interact with the device to cause the same insertion of tube 584 into interior chamber 542 of container 534.

Once tube 584 is inserted into port 580, displacement liquid 68 may be moved from the reservoir 592 and into the interior chamber 542 of container 534. As with other embodiments, vapor may be generated using a vapor generating device 1, as described herein. As shown in FIGS. 7 and 8, the vapor device illustrated is device 1B; however, bottom fill devices 3F and 3G may operate equally as well with any suitable vapor generating device.

Once vapor is being generated, displacement liquid 68 may be extracted from the container 534 and back into reservoir 592 through tube 584. The movement of displacement liquid 68 out of the interior chamber 542 of container 534 will draw vapor into the chamber 542. Once the desired volume of vapor is in the chamber 542, container 534 may be removed from the tube 584 and the vapor may be consumed as described herein with other vessels.

The removal of container 534 from tube 584 may cause port 580 to close, creating a tight seal to prevent the leakage of vapor and/or liquid out of chamber 542 through port 580.

As with other embodiments, the bottom fill extraction and consumption systems 510 and 610 may be used with consumable liquids, combinations of liquids and vapors, or with vapors. Similarly, containers 534 and/or 634 may be utilized with other filling and consumption methods described herein, including top filing devices, by switching lids (e.g. swapping lid 44 in for lid 544, etc.). Accordingly, it will be understood that the bottom fill devices 3F and 3G are contemplated for use with containers that have bottom ports 580; however, containers may be interchangeable and/or readily modified for use with any style of fluid storage and transfer device, as desired. Similarly, fluid storage and transfer devices 3F and 3G may be readily modified or adapted for use in other situations, such as filling containers with consumable liquids, and/or in conjunction with other fluid storage and transfer devices.

Although shown in various examples and exemplary embodiments, it will be understood that features and components of the various extraction and consumption systems 10, 110, 210, 310, 410, 510, and/or 610 may be combined, omitted, replaced, interchanged, and/or otherwise utilized as dictated by the desired implementation.

Accordingly, a generalized method of vapor production and consumption will now be described. First, vapor may be produced utilizing a vapor production device such as vapor production devices 1A and/or 1B. This vapor may be stored in a storage device and/or transferred directly into a vessel for consumption utilizing fluid displacement techniques wherein a first fluid, such as a displacement liquid 68, may occupy a portion of a container 34 which may be hermetically sealed before connecting container 34 to the vapor source, at which point the displacement liquid 68 may be mechanically removed from the interior of container 34, thus creating a vacuum which may draw vapor out of vapor production device and into the interior chamber of a container. Once the desired volume of vapor is transferred into a container, the vapor may be consumed akin to drinking a liquid by a consumer or user taking "sips" of vapor. This may facilitate easier and more socially acceptable methods of consuming vapor and vaporized products.

Various embodiments and components are described in relation to their operation both above and in further detail below; however, it will be understood that many elements and components of vapor system 10 may be interchangeable between embodiments (e.g. systems 110, 210, 310, 410, 510, and/or 610) and/or may be utilized interchangeably and/or with other similar systems. For example, fluid vessels 2 may be generally considered to be interchangeable with the various embodiments of fluid storage and transfer devices 3. Similarly, vapor production devices 1 may be utilized with any suitable fluid vessel 2 and/or any suitable fluid storage and transfer device 3 without deviating from the scope of the disclosure herein. It will be further understood that the element and components of vapor system 10 may be generally formed of any suitable material and/or have other shapes or configurations besides those described herein, as dictated by the desired implementation. According to one example, conduits may be glass, metal, plastic, or other similar materials and may vary depending upon both the desired operation and/or the desired aesthetic properties of a specific implementation. For example, where system 10 may be configured for individual consumer operation and use such as in an individual's home, components may be more utilitarian and less aesthetic while implementations for use in public settings such as bars, smoke shops/cigar lounges, or the like may be more elaborate or aesthetically pleasing while still maintaining the appropriate functionality, as discussed further below.

It will be further understood that system 10 may be adapted for individual, commercial, or any other suitable or desired use thereof and may include components of any suitable size, as desired. For example, portable systems may include single serving fluid vessels 2 and/or fluid storage and transfer devices 3 while commercial systems 10, contemplated for use on the premises, may utilize larger vessels 2 and/or fluid storage and transfer devices 3. Further, the size of various components may vary across implementations such that two similar systems may be sized differently according to the expected use thereof. For example, a high volume commercial establishment may utilize a larger fluid reservoir 94 and/or vapor production device 1 while an individual or smaller commercial establishment may utilize smaller components while both may maintain similarly sized vessels 2 and/or fluid storage and transfer devices 3.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. An apparatus for consuming vapor comprising:

an extraction device operable to extract vapor from an organic material sample below the combustion point of cellulose;

a fluid vessel having a container defining an interior chamber, the container having a lid with a vapor port defined therein;

a liquid port defined through a bottom of the container, wherein the liquid port comprises at least one of (i) a substantially planar self-sealing membrane and (ii) a substantially planar self-closing valve;

a fluid transfer device having a tube operably engaged with a reservoir:

wherein the tube is inserted into the liquid port to fill the interior chamber with a volume of liquid from the reservoir via the tube; and wherein as a vapor is generated via a vapor generating device, the volume of liquid from the interior chamber of the container is removed through the liquid port.

2. The apparatus of claim 1 wherein the fluid transfer device further comprises:

a filling tube having a tip operable to mechanically open the port.

3. The apparatus of claim 1 wherein the container is drinkware.

4. The apparatus of claim 1 wherein the vapor is simultaneously consumed through the vapor port with at least a portion of the volume of liquid from the fluid transfer device.

5. The apparatus of claim 1 wherein the vapor is consumed at a location remote from where the liquid is removed to draw the vapor into the container.

6. The apparatus of claim 1 wherein the container is drinkware and wherein the vapor is consumed by sipping the vapor from the container as if it were liquid.

7. The apparatus of claim 1 wherein the liquid port further comprises a channel.

8. The apparatus of claim 1 wherein the organic material comprises plant material.

9. The apparatus of claim 8 wherein the plant material comprises at least one of tobacco, hemp, *cannabis*, or combinations thereof.

* * * * *